US006012981A

United States Patent [19]

Fujioka et al.

[11] Patent Number: 6,012,981

[45] Date of Patent: Jan. 11, 2000

[54] GAME MACHINE FOR SINGLE PLAYER

[75] Inventors: Tatsuhiko Fujioka; Kuniyoshi Sato, both of Tokyo, Japan

[73] Assignee: Sigma Incorporated, Tokyo, Japan

[21] Appl. No.: 08/881,854

[22] Filed: Jun. 24, 1997

[51] Int. Cl.[7] ..... A63F 9/20

[52] U.S. Cl. ..... 463/11; 273/293

[58] Field of Search ..... 463/1, 11–13, 463/16, 25, 29–31, 36, 46; 273/292, 308, 138.2, 139, 293, 306, 309; 364/410.1, 411.1, 412.1

[56] References Cited

U.S. PATENT DOCUMENTS

| | | | |
|---|---|---|---|
| 4,380,334 | 4/1983 | Minkoff et al. | 463/11 |
| 5,601,488 | 2/1997 | Kadlic | 463/13 |
| 5,653,635 | 8/1997 | Breeding | 463/11 |

FOREIGN PATENT DOCUMENTS

| | | |
|---|---|---|
| 3-71914 | 11/1991 | Japan . |
| 2507126 | 6/1992 | Japan . |

OTHER PUBLICATIONS

Translation of JP 3–71914 by Schreiber Translations, Inc, 13 pages.

Translation of JP 2507126 by Schreiber Translations, Inc. 13 pp.

Solitaire Game for Microsoft Windows version 3.1, copyright 1985–1993, developed by Wes Cherry, 4 pp.

Whitnet, Eleanor Noss, "A Mah Jong Handbook, How to Play, Score, and Win the Modern Game", Charles E. Tuttle Company, Inc., Rutland Vermont and Tokyo Japan, 1964.

*Primary Examiner*—Valencia Martin-Wallace
*Assistant Examiner*—Mark A. Sager
*Attorney, Agent, or Firm*—Beyer & Weaver, LLP

[57] ABSTRACT

In a mah jong game apparatus for a single player, a predetermined number of tiles randomly selected from a plurality of tiles are supplied to only the single player, and the player completes a hand by combining own tiles while exchanging the supplied tiles and an arbitrary tile in a randomly supplied tile, thereby going out. Thus, the player can enjoy the game while concentrating on making hands independently.

10 Claims, 13 Drawing Sheets

GAME MACHINE FOR SINGLE PLAYER

BACKGROUND OF THE INVENTION

1. Field of the Invention

The present invention relates to a game machine for a single player and, in particular, to a video game machine for a single player, showing pictures of mah jong (Mah-Jongg) tiles and the like on a display screen and changing the display screen upon switching operations by the player so as proceed with a game such as mah jong.

2. Related Background Art

Conventionally known as video type mah jong game machines, for example, are those in which a player competes with a CPU or other players. In such machines, a CRT, which serves as a display screen, shows not only the player's hand and discarded tiles but also the opponents' discarded tiles and the like. The player makes own hands while taking into consideration the opponents' discarded tiles and the like. In such a competition type game, not only the player can claim opponents' discarded tiles but also the opponents can claim the player's discarded tiles.

In the conventional play-against-CPU type mah jong game machines, tiles may be dealt so as to be advantageous to the CPU side, or the CPU side may compulsively go out of a sudden so that the game is over. Accordingly, there have been many players who distrust the machines. Thus, the players, who are supposed to enjoy the game and have peace of mind, may only feel dissatisfied and accumulate stress instead. Also, in the mah jong games played with the game machine, the players tend to find satisfaction in completing hands which can hardly be attained in actual mah jong games. In the conventional game machines, however, the players have to play the games while always taking into consideration the opponents, claims, going out, and the like, and thus cannot concentrate on making their own hands. In particular, in the case where a beginner practices making hands for mah jong, the practice fails when an opponent suddenly goes out, thereby making it uninteresting to the beginner.

Namely, in order for a video type game machine to play a game which is enjoyable in that various kinds of hands are completed, the game becomes too simple to satisfy the player when its gist lies in that winning and loss are determined upon playing against the CPU.

SUMMARY OF THE INVENTION

In view of the foregoing problems of the prior art, it is an object of the present invention to provide a game machine for a single player in which the player can enjoy the game while independently concentrating on making hands.

According to one aspect of the present invention, there is provided a game machine for a single player in which a predetermined number of elements randomly selected from a plurality of elements are supplied to only the single player, and the player completes a hand by combining own elements while exchanging the thus supplied elements and an arbitrary unnecessary element in a randomly supplied element, thereby going out; the game machine comprising: element data storing means for storing an element data of the elements; first selecting means for randomly selecting a predetermined number of elements from elements corresponding to the element data stored in the element data storing means; image display means for displaying various kinds of images; display control means for causing the image display means to show a display image of the selected elements; residual element data storing means for storing an element data corresponding to an element other than the elements selected by the first selecting means; an operation switch for moving an arbitrary element selected from the predetermined number of elements shown by the image display means to another display area of the image display means; second selecting means for randomly selecting an element from the element data stored in the residual element data storing means; data rewriting means for rewriting, based on the element selected by the second selecting means, the data stored in the residual element data storing means; going-out data storing means for storing a plurality of going-out data formed by combination of the predetermined number of elements; and going-out judging means for judging whether or not the combination of the predetermined number of elements selected by the first and second selecting means coincides with at least one of the plurality of going-out data; wherein the image display means comprises: a point display area for showing a point corresponding to a going-out hand, an element display area for showing the elements supplied to the player, and an unnecessary element display area for showing the unnecessary element to be selected by way of the operation switch.

Here, "element" refers to an individual device used for a game such as card for card games, tile for mah jong, or the like.

In the above-mentioned game machine for a single player, the game is not played against the CPU, and a hand is completed by a predetermined number of elements randomly supplied from a plurality of elements. In order to complete a hand, the elements are exchanged for some times. In order to exchange the elements, the player moves, by means of the operation switch, the unnecessary element to be exchanged to another position in the image display means, whereas a substitute element is randomly supplied by the CPU from the residual elements other than the elements that have already been supplied. Since it does not perform a competition type game, the player can concentrate on making hands independently, thereby enjoying the game while feeling at ease. Also, since there are no opponents, the image display means shows only the player's own elements and information necessary for the game.

According to another aspect of the present invention, there is provided a mah jong game machine for a single player in which a predetermined number of tiles randomly selected from a plurality of tiles are supplied to only the single player, and the player completes a hand by combining own tiles while exchanging the thus supplied tiles and an arbitrary tile in a randomly supplied tile, thereby going out; the game machine comprising: tile data storing means for storing a tile data; first selecting means for randomly selecting a predetermined number of tiles from tiles corresponding to the tile data stored in the tile data storing means; image display means for displaying various kinds of images; display control means for causing the image display means to show a display image of the selected tiles; residual tile data storing means for storing a tile data corresponding to a tile other than the tiles selected by the first selecting means; an operation switch for moving an arbitrary tile selected from the predetermined number of tiles shown by the image display means to another display area of the image display means; second selecting means for randomly selecting a tile from the tile data stored in the residual tile data storing means; data rewriting means for rewriting, based on the tile selected by the second selecting means, the data stored in the residual tile data storing means; hand data storing means for storing a plurality of going-out hand data formed by combination of the predetermined number of tiles; and hand judging means for judging whether or not the combination of the predetermined number of tiles selected by the first and second selecting means coincides with at least one of the plurality of hand data; wherein the image display means comprises: a point display area for showing a point corresponding to a going-out hand, a dealt tile display area for showing the tiles selected by said first selecting means and supplied to the player, and a discarded tile display area for showing the discarded tile selected by way of the operation switch.

In this mah jong game machine for a single player, from tiles corresponding to the tile data stored in the tile data storing means, a predetermined number of tiles are randomly selected and dealt. Thereafter, from the tile data of the residual tile data storing means storing the tile data corresponding to the tiles (equivalent to wall tiles) other than the dealt tiles, one tile is randomly selected so as to allow drawing from the wall. Then, the player pushes the operation switch so as to move, of the own hand, an unnecessary tile to the discarded tile display area of the image display means. In this manner, a hand is completed by dealing of tiles and drawing from the wall (drawing and discarding) in a concealed manner. In this mah jong game machine, there are no claims such as pung and chow. Namely, the game is not played against the CPU, whereby the player can concentrate on making hands of mah jong and enjoy the game while feeling at ease. Also, since there are no opponents, the image display means shows only the player's own tiles, discarded tiles, and information necessary for the game.

The image display means may further comprise, in addition to the point display area, dealt tile display area, and discarded tile display area; a wind tile display area for showing a prevailing wind and the player's own wind, a bonus display area for displaying a bonus-indicating tile, a dealer's extra hand number display area for showing the number of dealer's extra hands, and a detailed information display area for showing detailed information of a hand which has gone out.

As the detailed information of a hand which has gone out is displayed, it helps a beginner of mah jong to understand the hand. The above-mentioned areas may be disposed so as not to overlap each other.

Since this game machine is not used for playing against the CPU, in the image display means, the point display area may be disposed at the upper portion where the opponents' discarded tiles and the like have conventionally been shown, the player's dealt tile display area may be disposed at the lower portion, and the player's discarded tile display area may be disposed between the point display area and the dealt tile display area.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
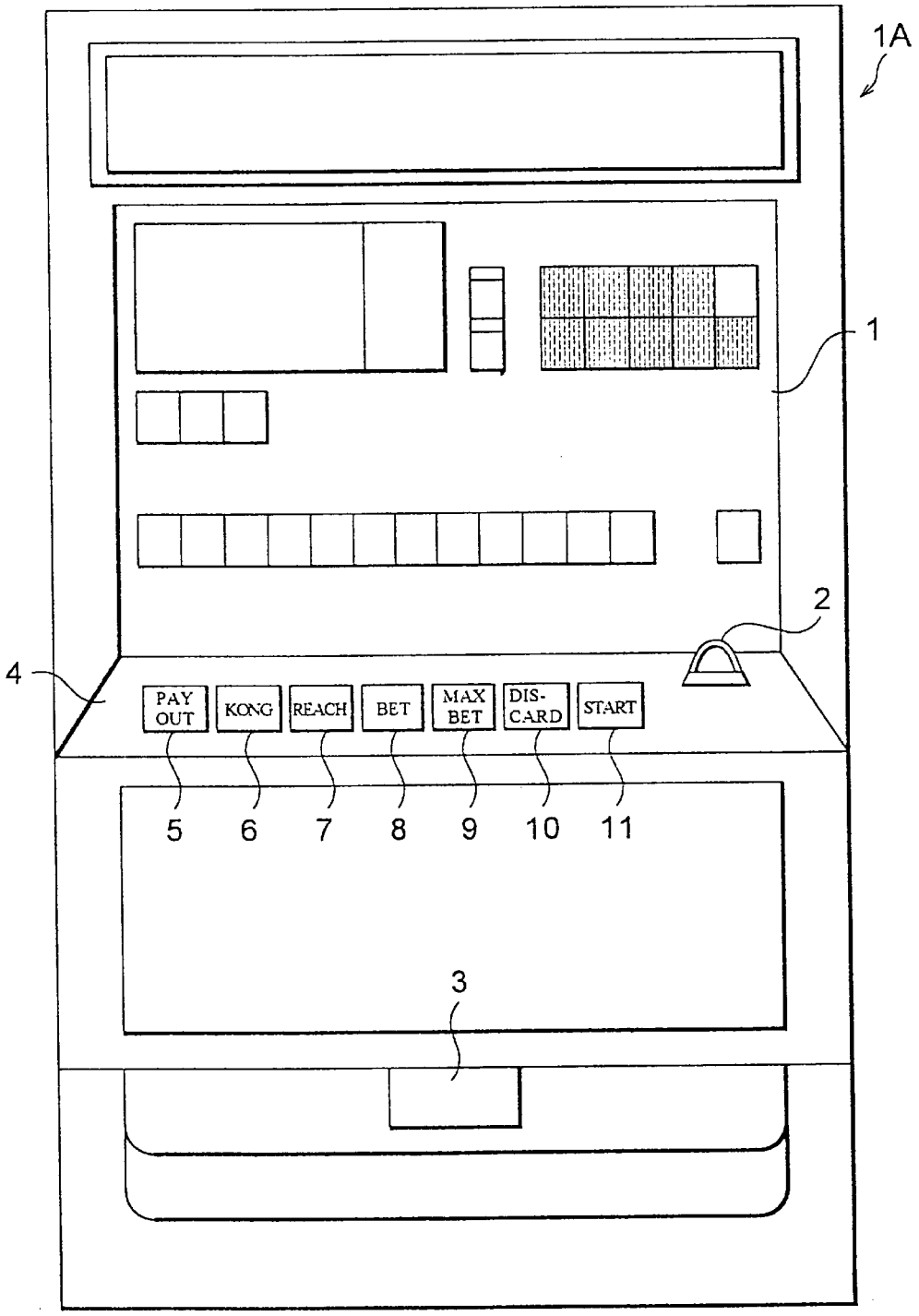
FIG. 1 is a schematic front view showing the appearance of a video type mah jong game machine which is a game machine for a single player in accordance with an embodiment of the present invention.

FIG. 1 is a schematic front view showing the appearance of a video type mah jong game machine which is a game machine for a single player in accordance with an embodiment of the present invention.

Attached to the front face of this video type mah jong game 1A is a CRT 1 as image display means. A coin insertion slot 2 is formed below the CRT 1 on the right side, whereas a coin discharge slot 3 is located at the center of the lower portion of the game machine 1A. Disposed on the left side of the coin insertion slot 2 is a game switch section 4 composed of a plurality of operation switches for proceeding with the game. Successively positioned as the operation switches in the game switch section 4 from the left side are a PAYOUT switch 5 (also used for "going out"), a kong switch 6, a ready-declaration switch 7, a BET switch 8, a MAX BET switch 9, a tile-discarding switch 10, and a START switch 11.

Before playing a game, a player inserts coins into the coin insertion slot 2. Depending on the number of thus inserted coins, a bet rate (BET) is determined. For example, when three coins are inserted, the coins to be paid out are tripled. Also, the number of inserted coins is indicated by a coin number display section located at the lower portion of the CRT 1. Thereafter, when the START switch 11 in the game switch section 4 is pushed, tiles are dealt, whereby the game is started. The dealing of tiles is determined according to random number control effected by a random number generator by way of a microcomputer.

Figure 2:
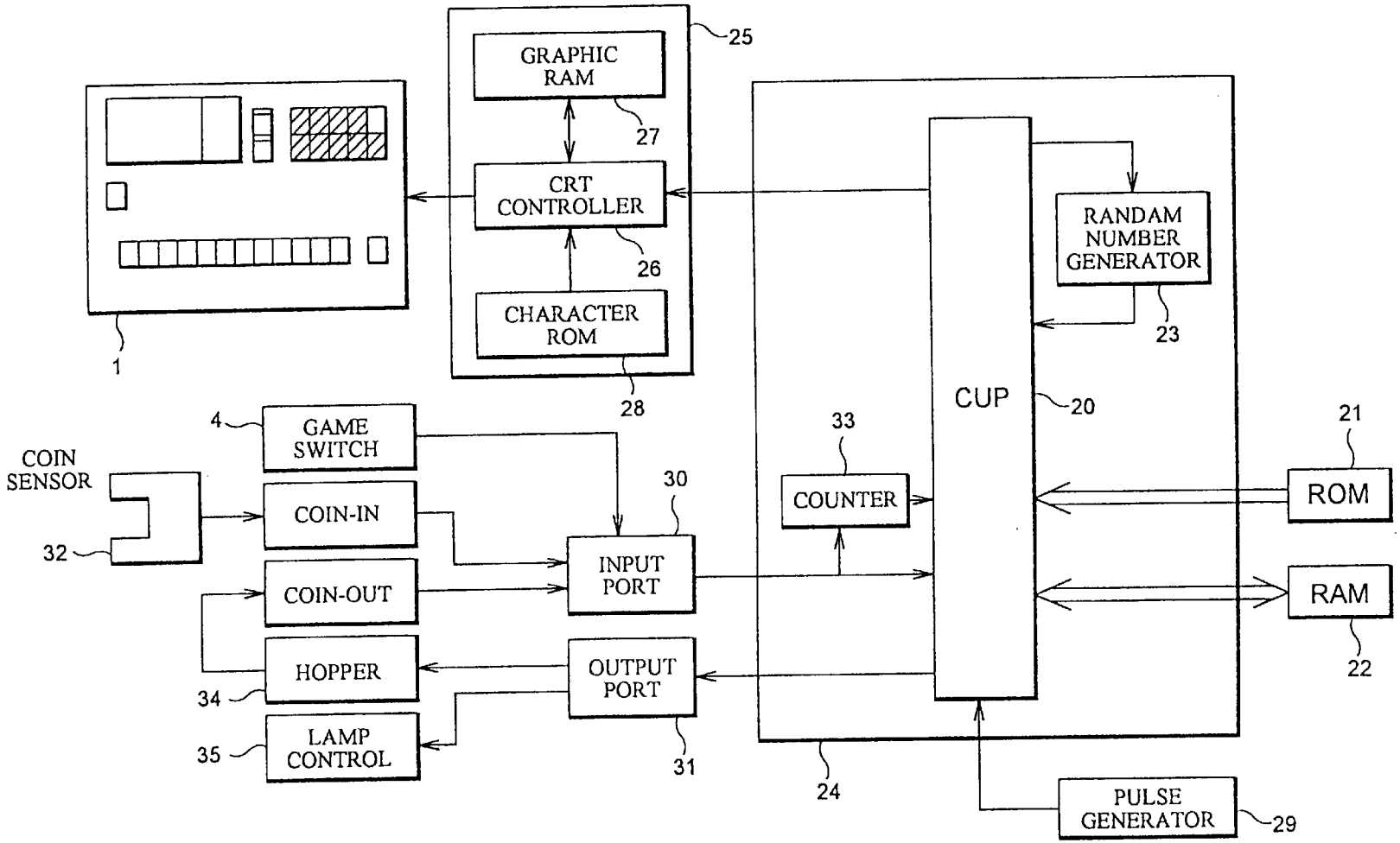
FIG. 2 is a block diagram showing a basic controlling and processing system in the video type mah jong machine in accordance with the above-mentioned embodiment.

FIG. 2 is a block diagram showing a basic controlling and processing system in the video type mah jong machine in accordance with this embodiment.

In FIG. 2, a CPU 20 performs various arithmetic operations according to input signals, thereby controlling and processing individual sections. To this CPU 20, a ROM 21 and a RAM 22 are connected as storage means. Stored in the ROM 21 are a program for controlling the whole game, various kinds of tile data concerning tiles such as tile picture data, a plurality of going-out hand data formed by combination of a predetermined number of tiles, a program concerning image processing, and the like. Contained in the RAM 22 are such data as those concerning the number of coins fed into the coin insertion slot 2 before the game is started, tiles displayed on the CRT 1, positions at which they are displayed, residual tiles, number of won coins for the game, and number of payout coins.

Namely, the ROM 21 stores the combinations of tile data corresponding to hands, while the RAM 22 contains data of the player's own hand displayed on the CRT 1 or the like. Accordingly, as the data in the ROM 21 and the data contained in the RAM 22 are compared with each other, the CPU 20 can judge whether the combination of the player's tiles is a hand entitled to going out or not.

In response to a random number generated by a random number generator 23, the CPU 20 randomly selects (deals) a predetermined number of tiles from tiles corresponding to the tile data stored in the ROM 21. Also, from the tile data of the RAM 22 storing the residual tile data corresponding to the tiles other than those thus selected, the CPU 20 randomly selects a tile (to be drawn from the wall). Numeral 24 refers to a microcomputer.

The CRT 1 is driven by way of the CPU 20 and a CRT driving unit 25, whereby dealt tiles, discarded tiles, bonus-indicating tiles, and the like are shown at their predetermined display areas on its display screen. The CRT driving unit 25 comprises a CRT controller 26 for controlling the image display of the CRT 1, a graphic RAM 27 for temporarily storing graphic data to be fed to the CRT 1, and a character ROM 28 storing character data and the like.

A pulse generator 29 supplies a clock pulse to the CPU 20, whereby the latter proceeds with the game according to the game program stored in the ROM 21. Upon this operation of the CPU 20, the CRT controller 26 is actuated so as to sequentially access to the tile data to be displayed on the CRT 1 in the character ROM 28, whereby tiles are displayed on the CRT 1. Also, the tile data being displayed are stored into the RAM 22 while being sequentially rewritten.

An input port 30 and an output port 31 are connected to the CPU 20. Before the game is started, the number of inserted coins is counted by a counter 33 according to the data fed from the input port 30 by way of a coin sensor 32. The bet rate for the game is determined by the number of inserted coins. Also, the various switches 5 to 11 disposed in the game switch section 4 are connected to the input port 30. On the other hand, according to a signal from the CPU 20, the output port 31 outputs a driving signal to a hopper 34. In response to the signal from the output port 31, the hopper 34 pays out a predetermined number of coins corresponding to the kind of completed hand. Also, a lamp control section 35 is connected to the output port 31.

In the case where the game is played after the BET switch 8 of the game switch section 4 is pushed, the number of coins identical to the number of coins to be paid out is displayed on the CRT 1 as a credit, while no coins are paid out. The number of coins to be paid out that has been credited is treated in the same manner as the coins. Namely, as the BET switch 8 is pushed once, one coin is supposed to be inserted, whereby 1 is subtracted from the number of credited coins displayed on the CRT 1. In the case where the MAX BET switch 9 is pushed when the maximum number or more of the coins to be inserted in one game remain in the credit, the maximum number of coins to be inserted in this game is assumed to be inserted, whereby the maximum number of the coins to be inserted is subtracted from the number of credited coins displayed on the CRT 1. When the PAYOUT switch 5 in the game switch section 4 is pushed, the number of credited coins displayed on the CRT 1 are paid out from the coin discharge slot 3.

Figure 3:
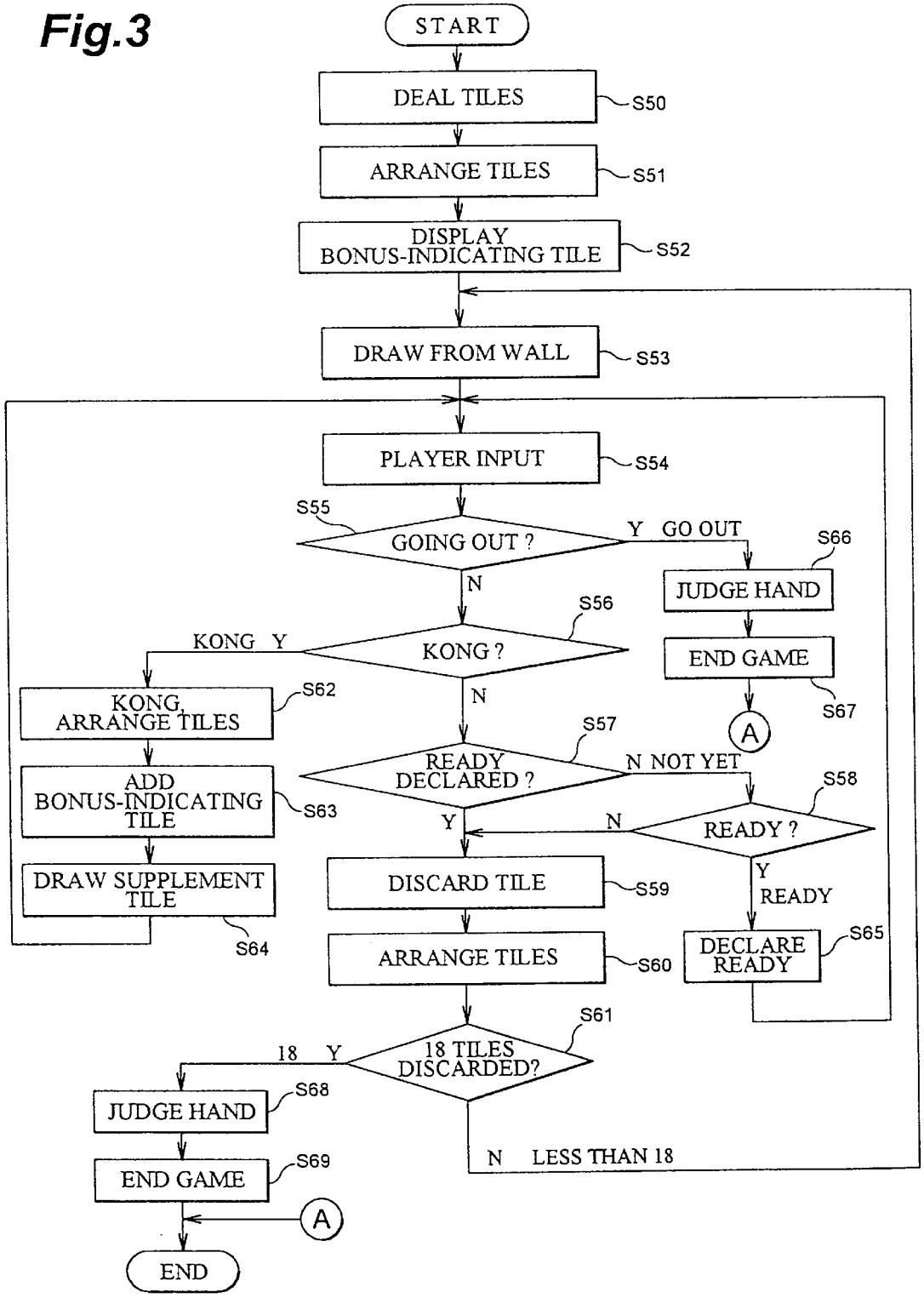
FIG. 3 is a flow chart showing an operation of the video type mah jong machine in accordance with the above-mentioned embodiment.

FIG. 3 is a flow chart showing an operation of this mah jong machine, whereas FIGS. 4 to 23 are schematic plan views respectively showing specific examples of image display contents according to the proceedings of the game. In the following explanation, the proceedings of the game are controlled and processed by the CPU 20.

First, the coin sensor 32 detects, one by one, the coins inserted into the coin insertion slot 2, whereby the number of pulses generated as the coins are detected is read out, by way of the input port 30, into the CPU 20 as the number of inserted coins. The number of coins read out into the CPU 20 is caused by the latter to be recorded into RAM 22. The CPU 20 transmits the number of inserted coins not only to the RAM 22 but also to the CRT 1 after converting it into data for the CRT 1. The CRT 1 displays, as WAGER (bet rate), the number of inserted coins read out into the CPU 20.

Figure 4:
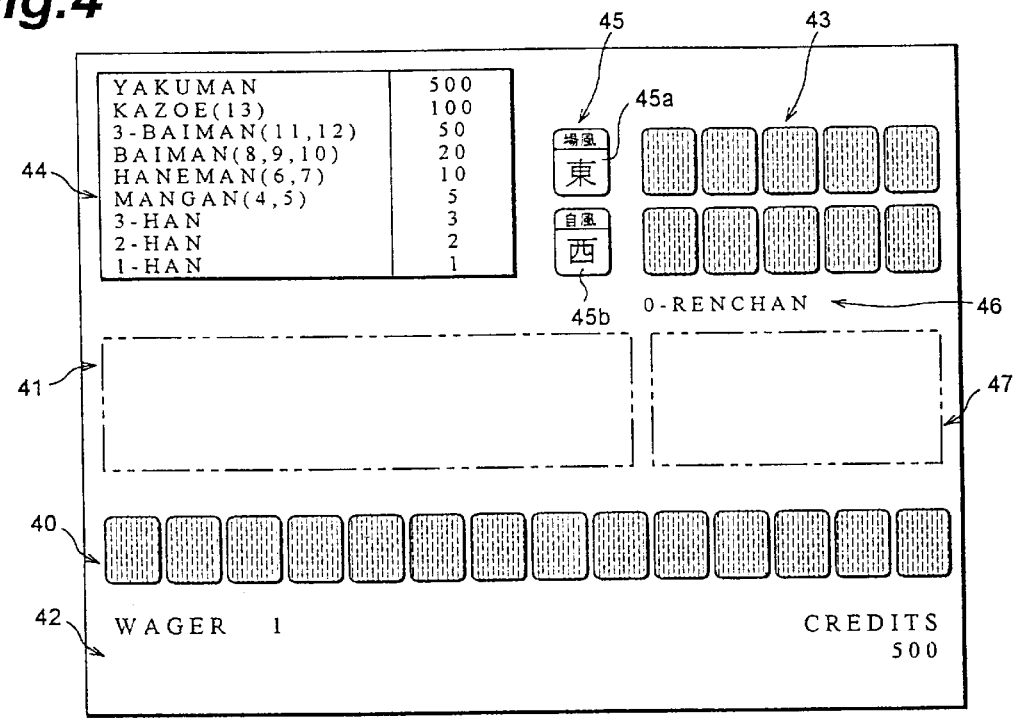
FIGS. 4 to 23 are schematic plan views respectively showing specific examples of image display contents in the video type mah jong game machine in accordance with the above-mentioned embodiment.

FIG. 4 shows an initial screen displayed at the time when the coins are inserted. Formed on the CRT 1 are a dealt tile display area 40, located at the lower portion of the CRT 1, for showing dealt tiles in a horizontal row; a discarded tile display area 41 (indicated by chain double-dashed line in FIG. 4), located above the dealt tile display area 40 so as to extend from the center to left side of the CRT 1, for showing discarded tiles; a coin display area 42, located below the dealt tile discharge area 40, for displaying the number of coins in connection with such items as WAGER and CREDITS; a bonus display area 43, located at the upper right portion of the CRT 1, for showing bonus-indicating tiles; a point display area 44, located at the upper left portion of the CRT 1, for showing, as a table, the point (number of coins to be paid out) corresponding to the player's hand (number of doubles); and a wind tile display area 45, located between the bonus display area 43 and the point display area 44, for showing wind tiles respectively corresponding to a prevailing wind and the player's own wind. Here, below the bonus display area 43, a dealer's extra hand number display area 46 for displaying the number of dealer's extra hands (RENCHAN) is disposed. Also, secured on the right side of the discarded tile display area 41 is a detailed information display area 47 (indicated by chain double-dashed line in FIG. 4) for showing, as auxiliary information, detailed contents of the number of doubles for the completed hand when going out. Here, the areas 40 to 47 do not overlap each other.

In the initial screen shown in FIG. 4, the dealt tile display area 40 shows 14 pieces of tiles all facing down. Also, the bonus display area 43 shows no bonus-indicating tile, and all of 10 tiles (5 stacks) face down there. The wind tile display area 45 shows the prevailing wind and player's own wind randomly selected by way of the random number generator 23. In FIG. 4, the east wind tile 45*a* as the prevailing wind and the west wind tile 45*b* as the player's own wind are depicted. The point display area 44 displays points for paying out coins corresponding to numbers of doubles such as MANGAN. Also, numbers of coins are respectively displayed in connection with WAGER and CREDITS.

Figure 5:
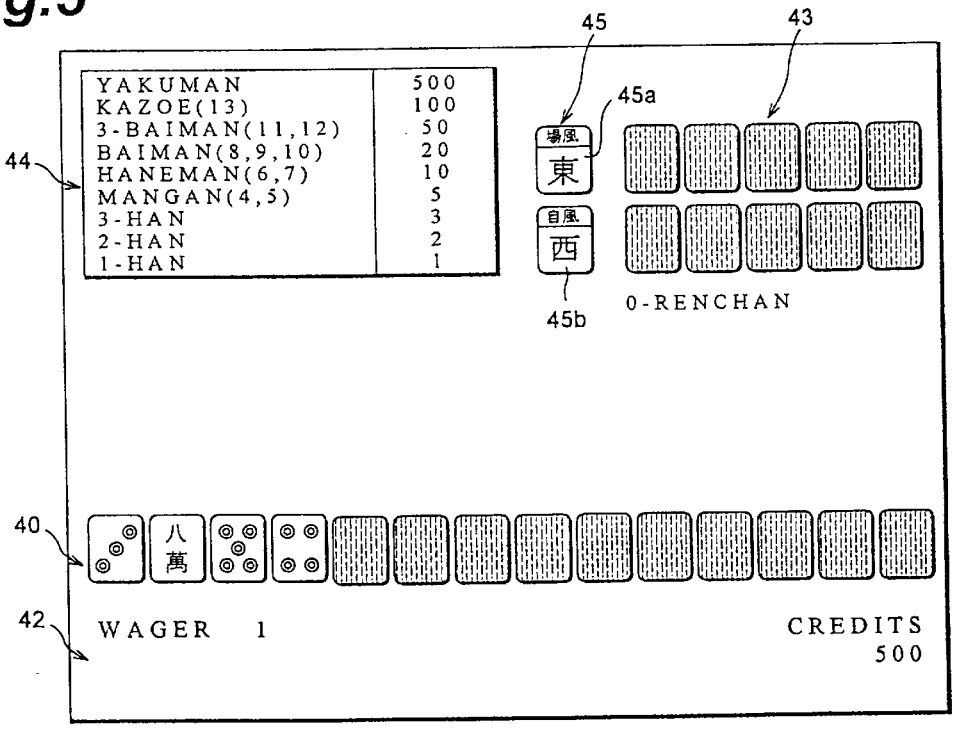
Figure 6:
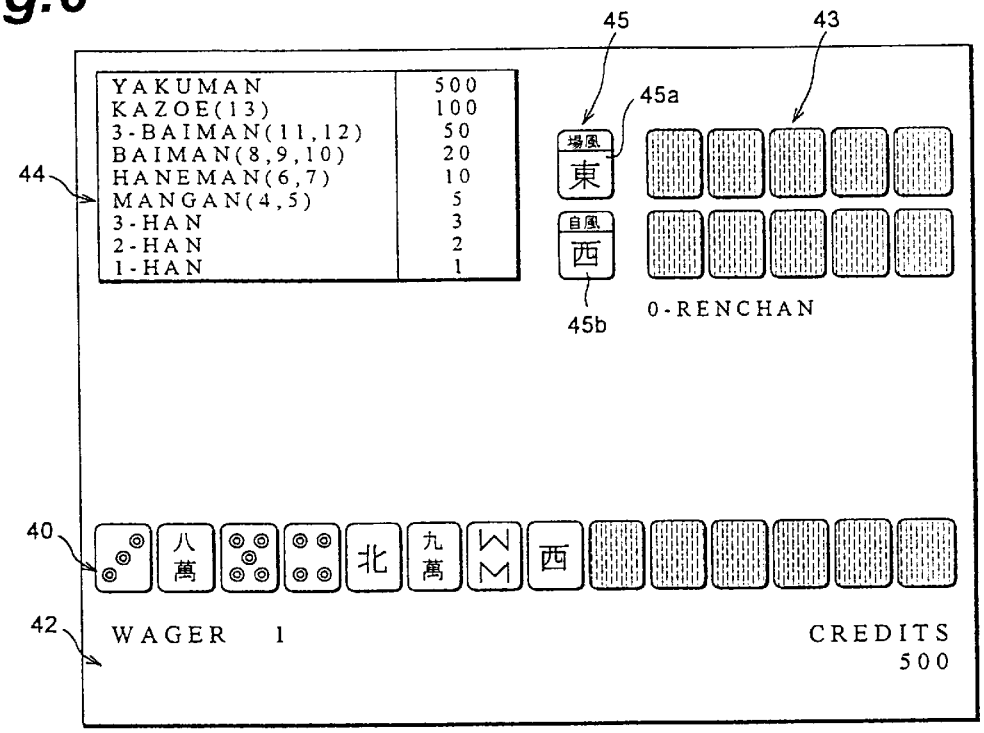
Figure 7:
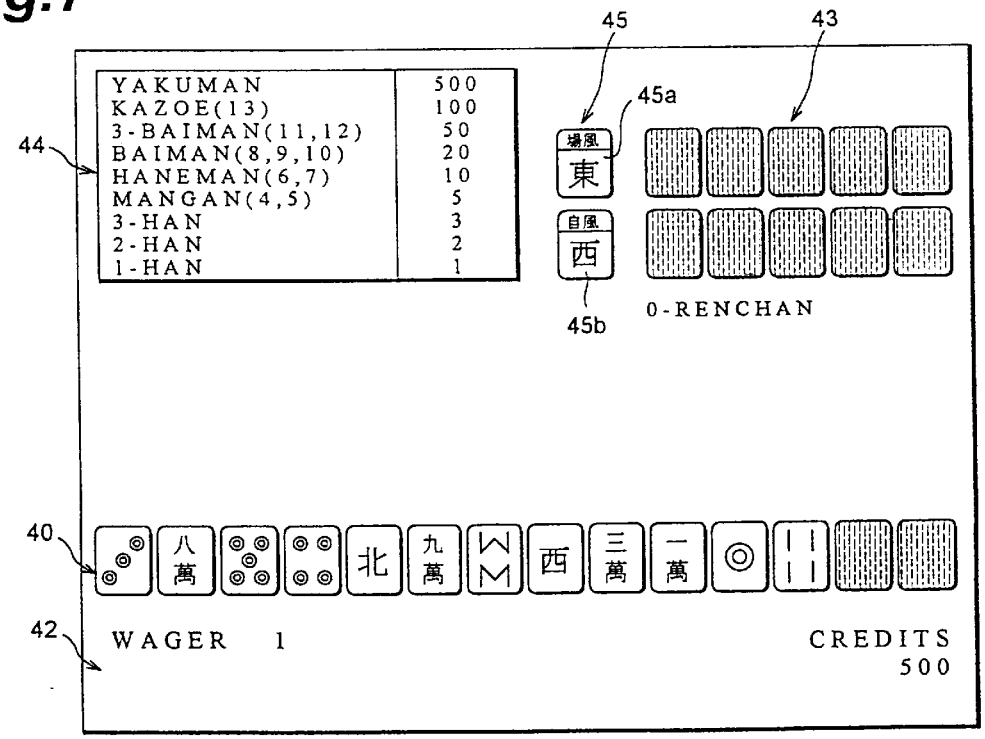
Figure 8:
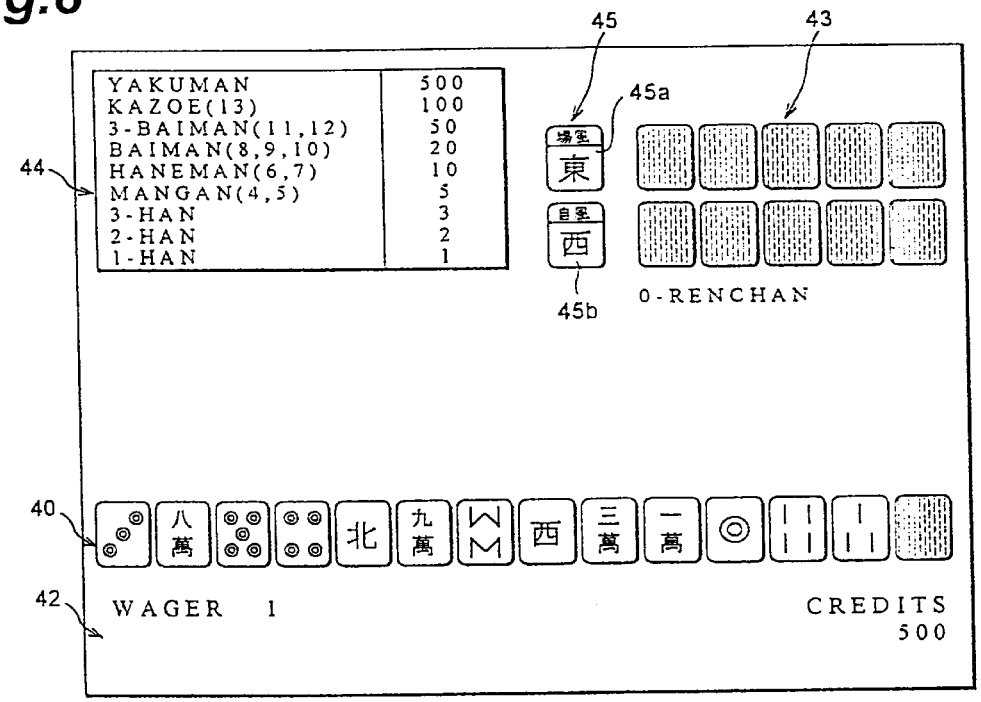
Figure 9:
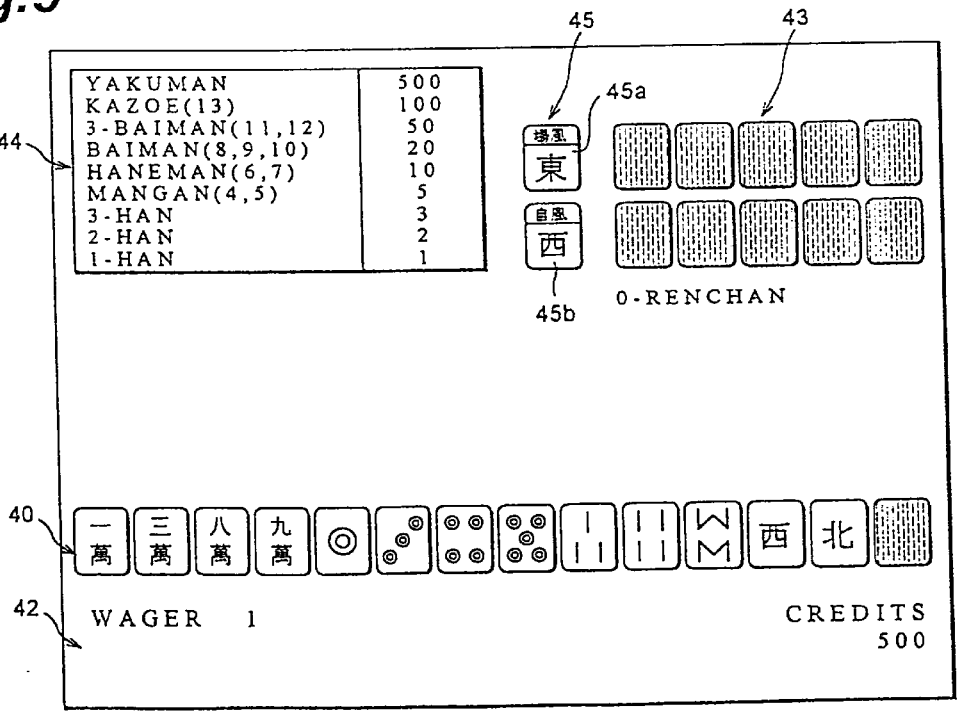
Figure 10:
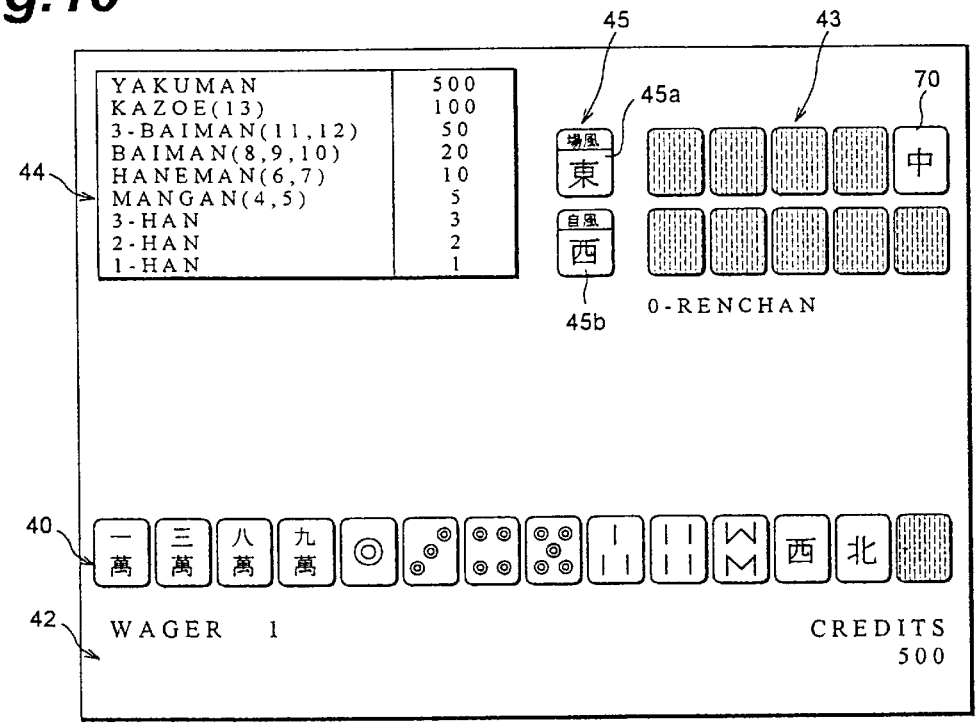

When the player pushes the START switch 11 in the state shown in FIG. 4, in response to the resulting signal, 13 tiles are randomly selected from 136 tiles corresponding to the tile data stored in the ROM 21, whereby dealing of tiles is started (step 50 in FIG. 3). In the dealing of tiles, as shown in FIGS. 5 to 7, the faced-down 14 tiles are successively faced up 4 by 4, with presence, until 12 tiles face up. The thirteenth tile is faced up alone as shown in FIG. 8, thereby terminating the dealing of tiles. After dealing the tiles, at step 51, arrangement of tiles is performed as shown in FIG. 9 such that the tiles of the same kind in the dealt tile display area 40 are placed in their numerical order. Thereafter, as shown in FIG. 10, a bonus-indicating tile is shown so as to face up at the right upper end of the bonus display area 43 (step 52). In FIG. 10, a red dragon tile 70 randomly selected from the residual tiles other than those dealt is the bonus-indicating tile.

Figure 11:
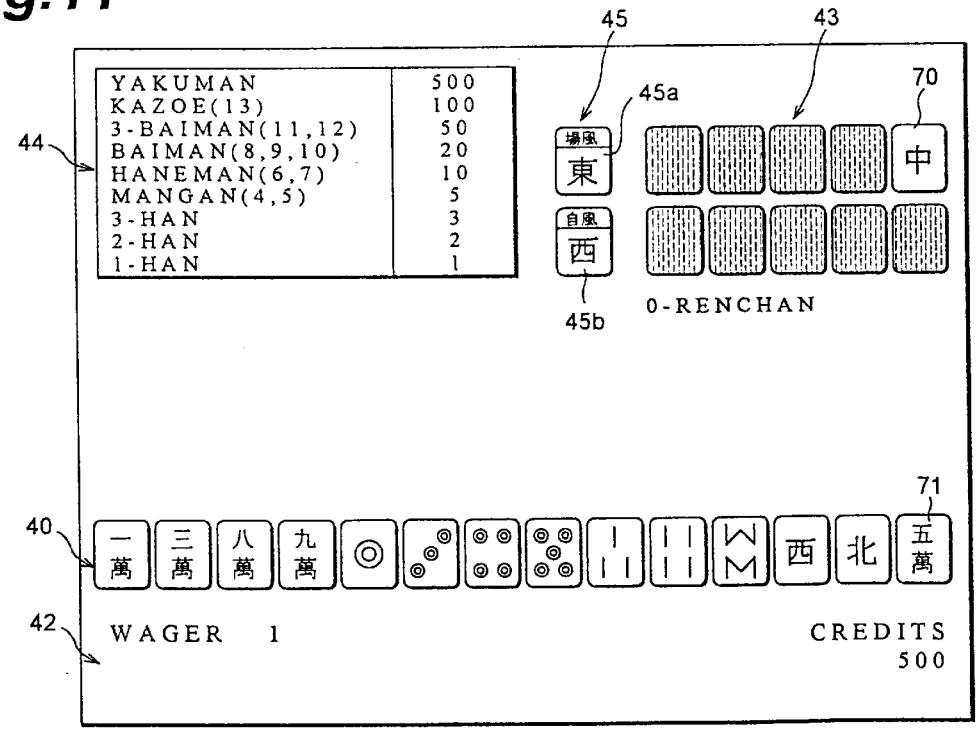

At step 53, as shown in FIG. 11, a tile is randomly selected from the residual tile data stored in the RAM 22 other than the dealt tiles, whereby drawing from the wall is automatically performed. In FIG. 11, a character five tile 71 at the right end of the dealt tile display area 40 is the tile drawn from the wall. At this moment, the number of the player's tiles becomes 14.

Figure 12:
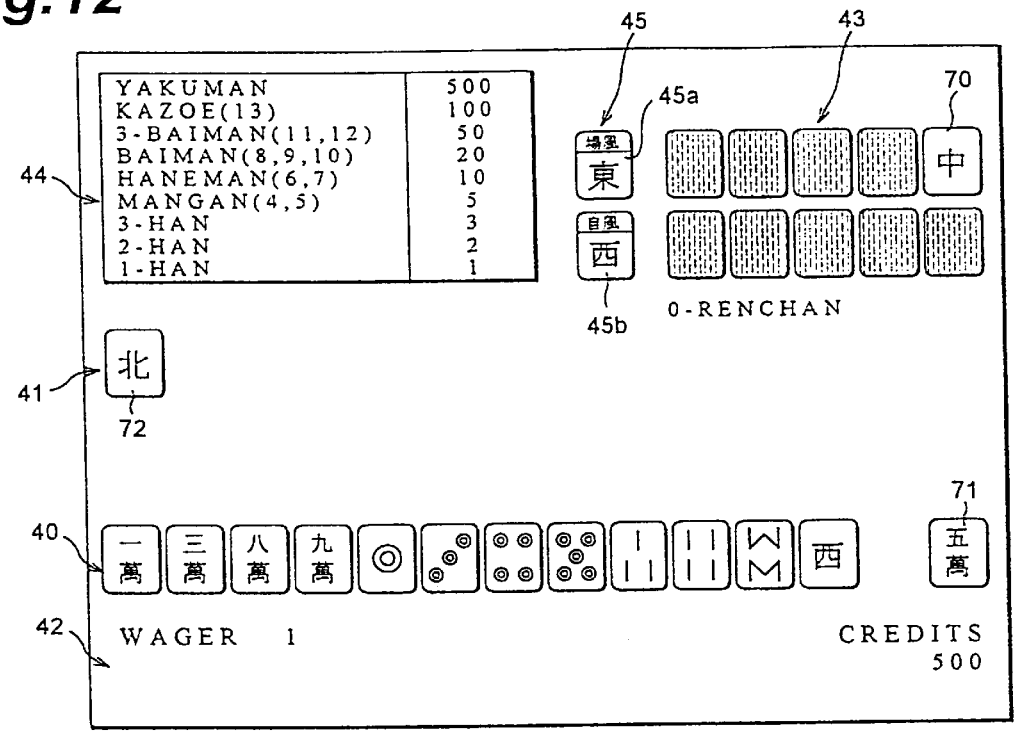
Figure 13:
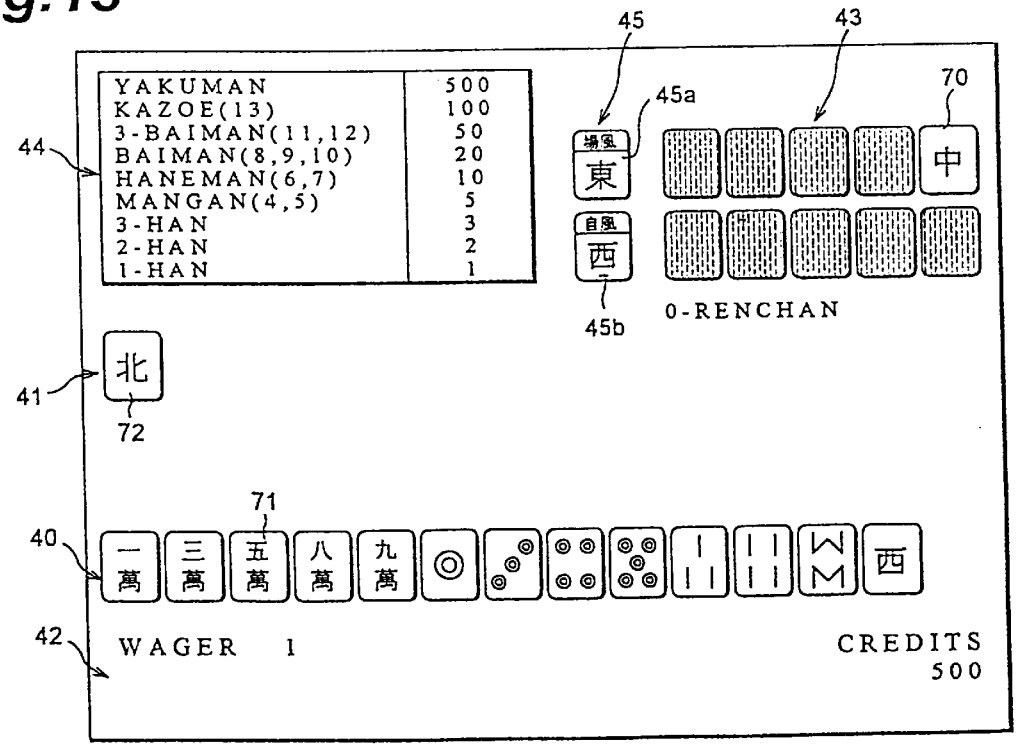

Thereafter, as the player pushes (step 54) one of the PAYOUT (going out) switch 5, kong switch 6, ready-declaration switch 7, and tile-discarding switch 10 in the game switch section 4, the game proceeds to the next step. FIG. 12 shows the state in which the tile-discarding switch 10 is pushed so as to choose a north wind tile 72 and move it to the discarded tile display area 41 (step 59) in the case where it is judged "NO" at all of the steps 55, 56, 57, and 58, i.e., the case where there are no going out, no kong (concealed four), no finished ready declaration, and no ready declaration to be effected. At this moment, the character five tile 71 has not been arranged with the other tiles. At the subsequent step 60, as shown in FIG. 13, the character five tile 71 is placed in order.

Figure 14:
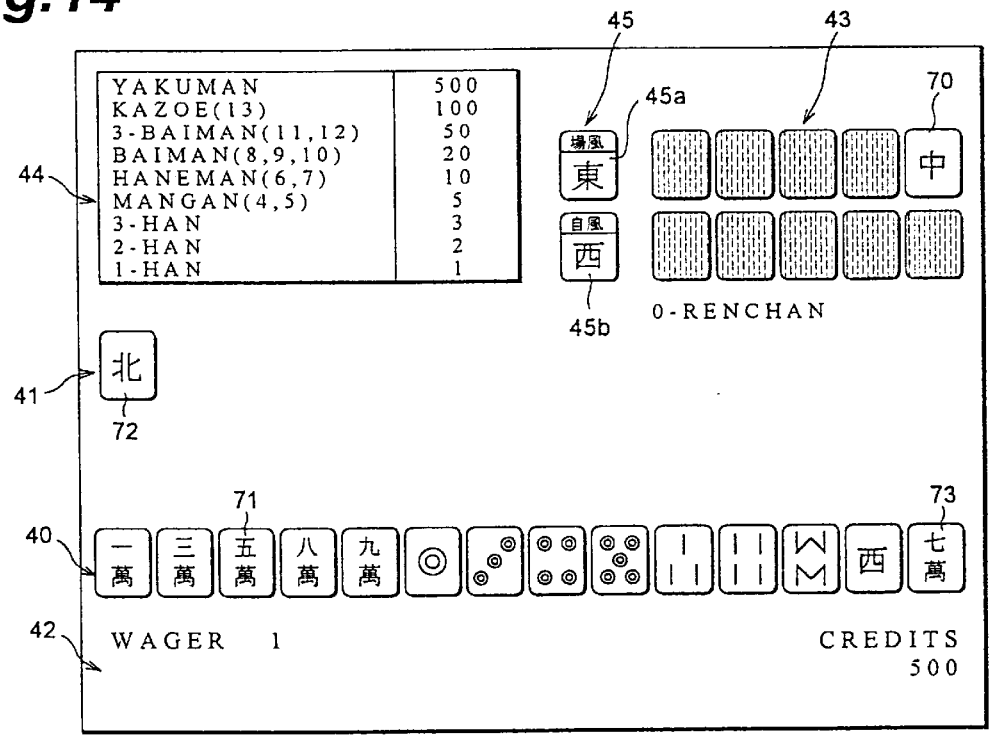
Figure 15:
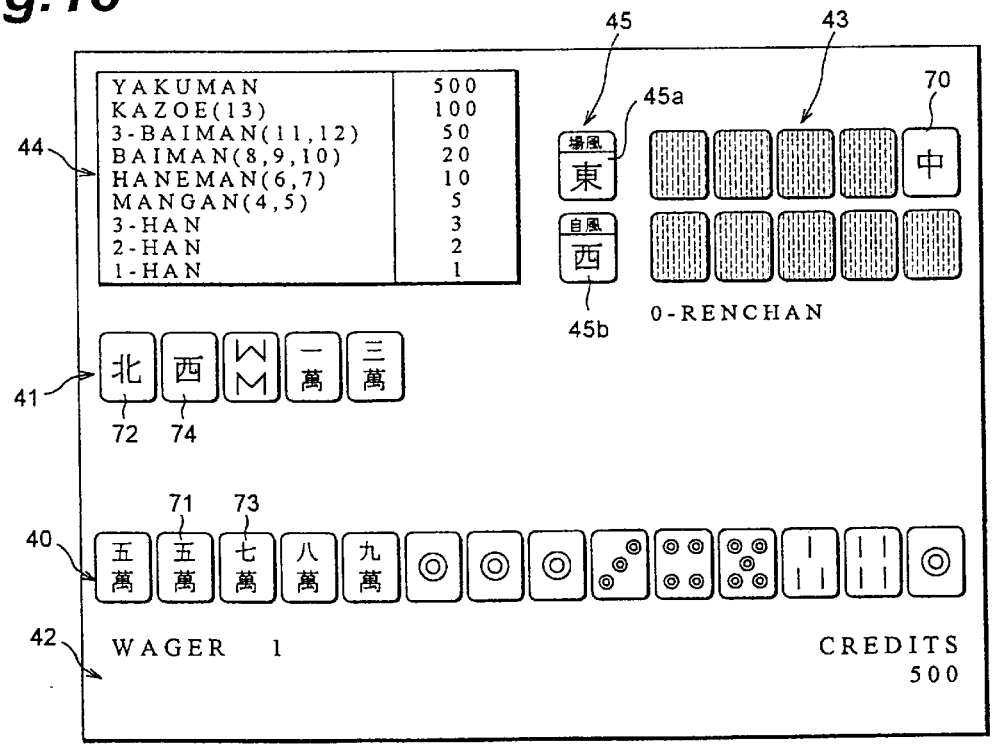

After the arrangement of tiles, it is judged whether the total number of the discarded tiles is less than 18 ("NO" at step 61) or all of 18 tiles are dealt ("YES" at step 61). When less than 18 tiles have been discarded, at step 53, a tile is randomly selected from the residual tile data stored in the RAM 22 as shown in FIG. 14, whereby drawing from the wall is automatically effected. In FIG. 14, a character seven tile 73 at the right end of the dealt tile display area 40 is the tile drawn from the wall. At this moment, the number of the player's tiles becomes 14. Then, as mentioned above, the player pushes the tile-discarding switch 10 so as to discard a west wind tile 74 and subsequently repeats drawing from the wall and discarding of tiles. FIG. 15 shows the state where, after the west wind tile 74 is discarded, the fourth drawing from the wall (step 53) is performed.

Figure 16:
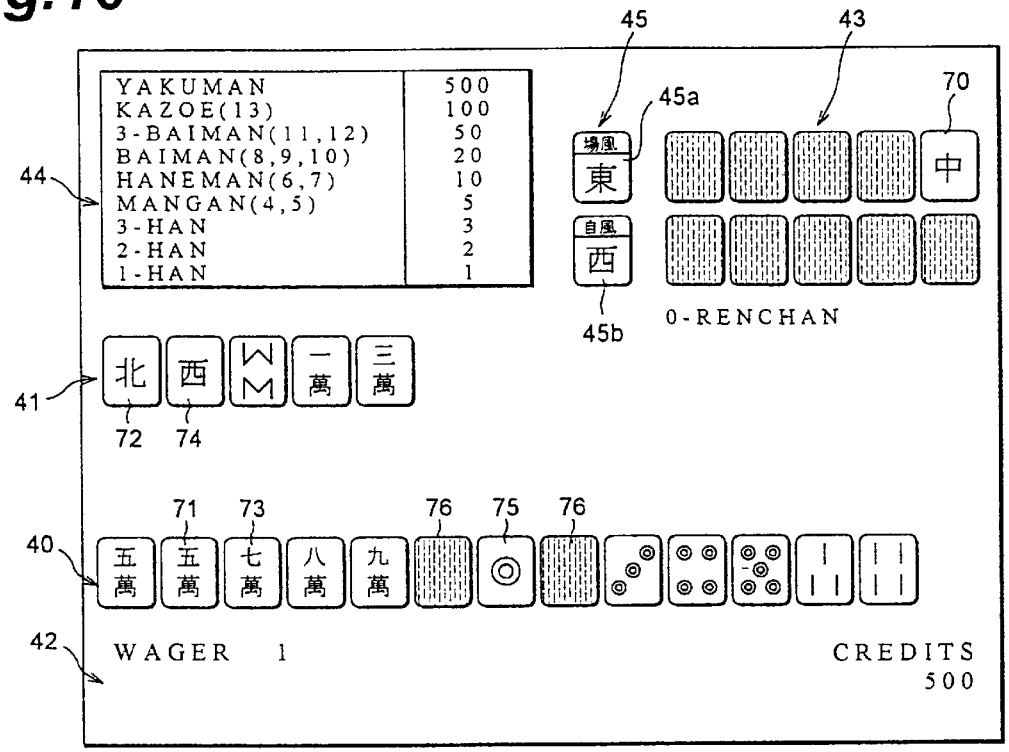

FIG. 16 shows the state where, since there are 4 dot tiles numbered one, such as a dot tile numbered one 75, in the player's tiles, the player pushes the kong switch 6 so as to declare kong ("NO" at step 55 and "YES" at step 56). At step 62, arrangement of tiles is effected together with kong. At this moment, since up to 14 tiles can be shown in the dealt tile display area 40 in this embodiment, kong composed of four tiles is displayed such that both end tiles 76 in 3 tiles in a row face down whereas the dot tile numbered one 75 at the center of the 3 tiles faces up. Accordingly, when kong is declared, the player's hand, which should originally be 14 tiles, is displayed with 13 tiles.

Figure 17:
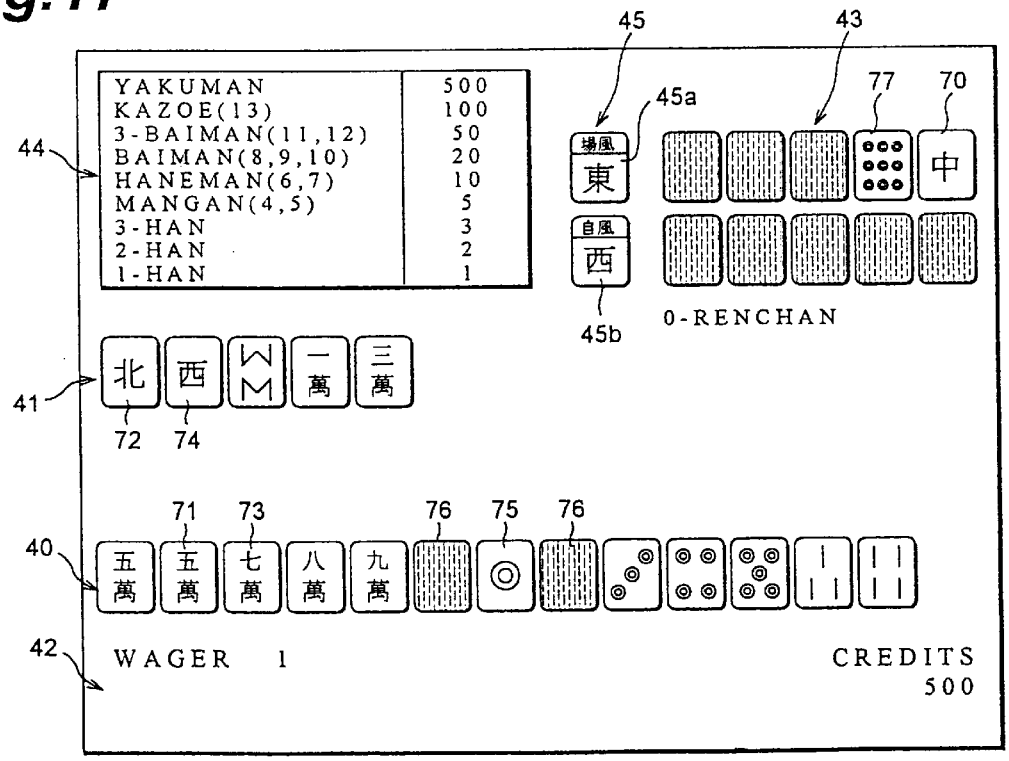
Figure 18:
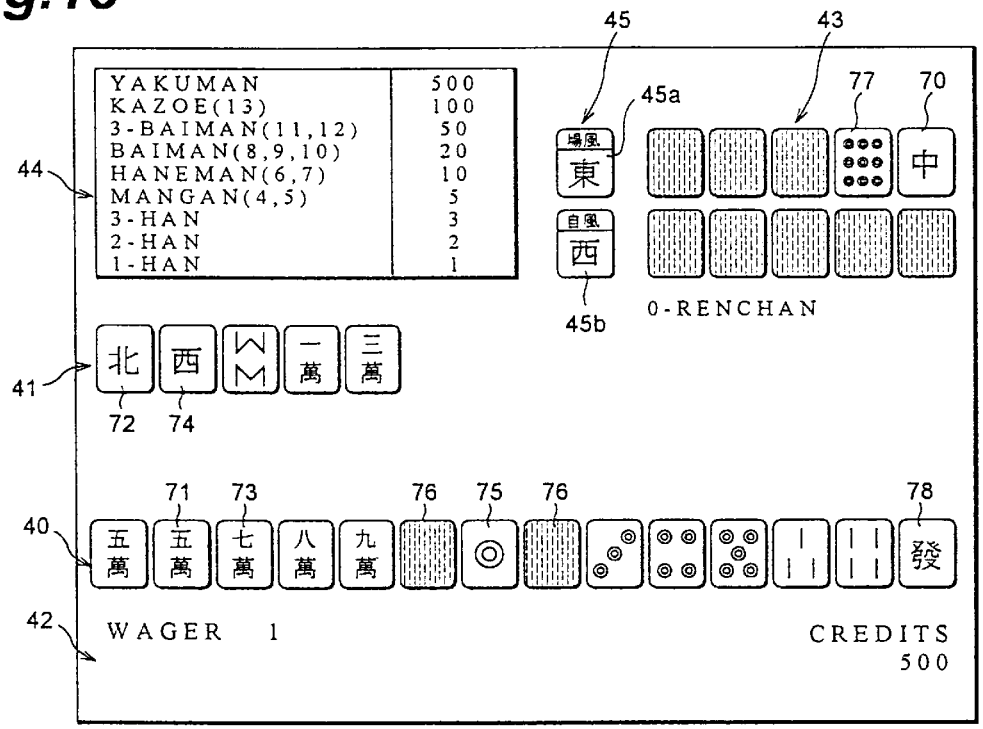

Subsequently, at step 63, since kong has been declared, a bonus-indicating tile is additionally displayed. FIG. 17 shows the state where a dot tile numbered nine 77, which is a bonus-indicating tile randomly selected from the residual tiles, faces up. Since the game machine in accordance with the present invention is intended for a single player, there are no claims, and kong encompasses "concealed four" alone. Before a supplement tile is drawn, the additional bonus-indicating tile is displayed. FIG. 18 shows the state where, after the additional bonus-indicating tile is displayed, a green dragon tile 78, which is a supplement tile randomly selected from the residual tiles, is drawn (step 64).

Thereafter, at step 54, as the player pushes one of the PAYOUT (going out) switch 5, kong switch 6, ready-declaration switch 7, and tile-discarding switch 10 in the game switch section 4, the game proceeds to the next step. In the case where it is judged "NO" at all of the steps 55, 56, 57, and 58, i.e., the case where there are no going out even after drawing of the supplement tile, no kong (concealed four), no finished ready declaration, and no ready declaration to be effected, the tile-discarding switch 10 is pushed so as to choose the green dragon tile 78 and move it to the discarded tile display area 41 (step 59) . When the total number of discarded tiles is less than 18 ("NO" at step 61), a tile is automatically drawn from the wall at step 53.

Figure 19:
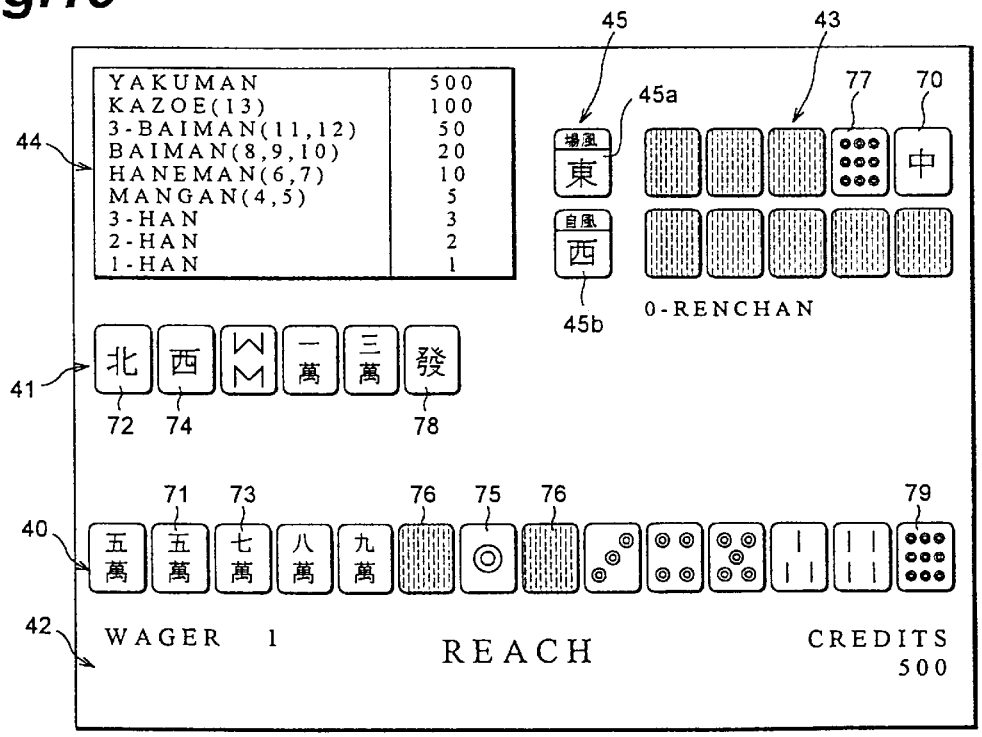

FIG. 19 shows the state where a dot tile numbered nine 79, which is randomly selected from the residual tiles at step 53, is drawn from the wall and then the ready-declaration switch 7 in the game switch section 4 is pushed at step 54 ("NO" at steps 55, 56, and 57, "YES" at step 58, and "ready" is declared at step 65). In this case, as shown in FIG. 19, characters of "REACH" are displayed at the center portion of the coin display area 42.

Figure 20:
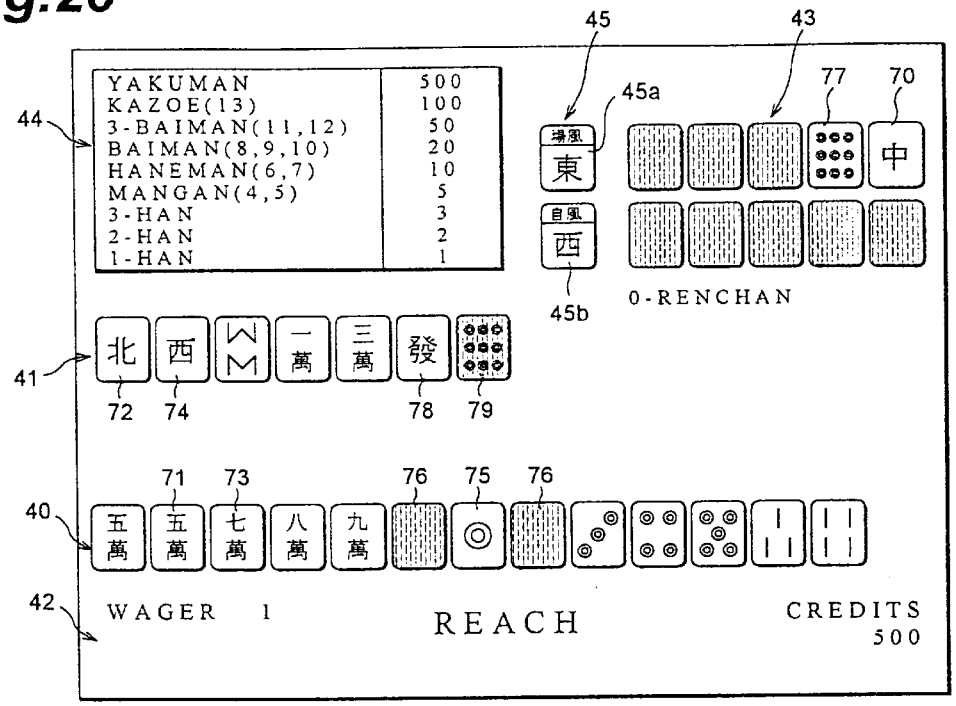

Thereafter, when the player pushes the tile-discarding switch 10 so as to choose the dot tile numbered nine 79 as a tile to be discarded, this tile is moved to the discarded tile display area 41. Then, as shown in FIG. 20, the dot tile numbered nine 79 moved to the discarded tile display area 41 is marked differently from the other tiles such that the time at which "ready" has been declared can be seen. Here, the marking can appropriately be set such that the tile is displayed brighter than the other tiles or in a different color, for example.

Figure 21:
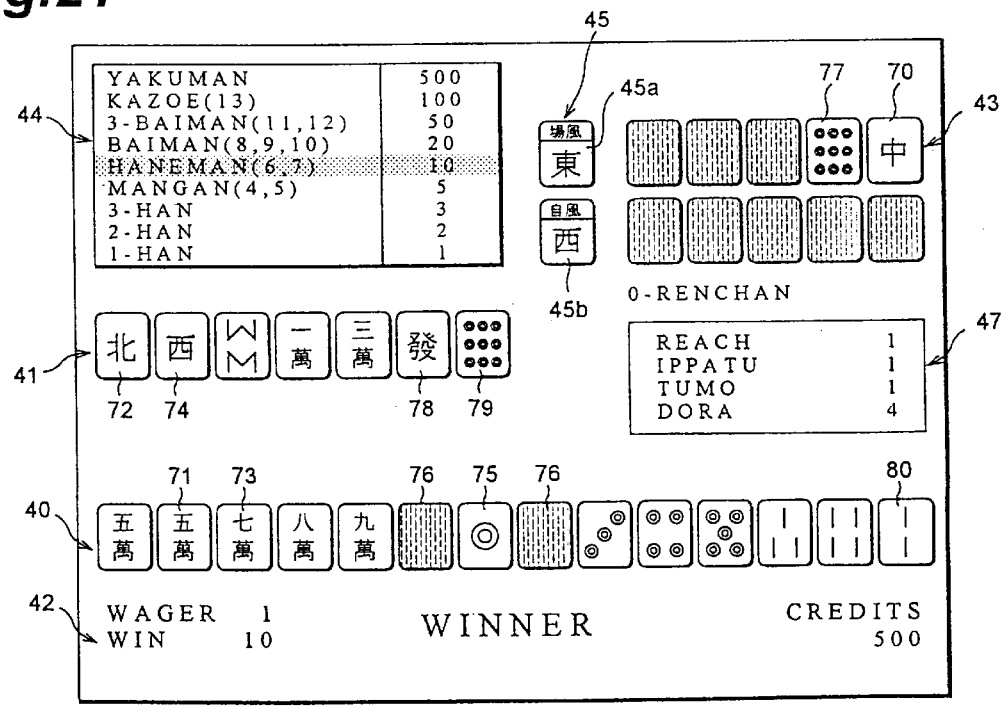

Then, at step 53, drawing from the wall is performed again. FIG. 21 shows the case where a bamboo tile numbered two 80 is drawn from the wall. Due to the drawing of this tile, a going-out state is achieved. Accordingly, the player pushes the going-out switch (PAYOUT switch) 5 ("YES" at step 55), whereby the hand is judged at step 66. Whether going out is permitted or not is judged at the discretion of the player. At this moment, together with the judgment of the hand, its points are computed, whereby the detailed information display area 47 shows detailed information about how the total number of doubles in the hand is determined. Also, in the table of the point display area 44, the item coinciding with the hand is marked differently from the other items. As in the case of ready declaration, this marking can appropriately be set such that the tile is displayed brighter than the other tiles or in a different color, for example. Further, "REACH" indicated at the center portion of the coin display area 42 is changed to an indication of "WAGER." Also, below the indication of "WAGER" in the coin display area 42, the number of winning coins is displayed together with an indication of "WIN."

Figure 22:
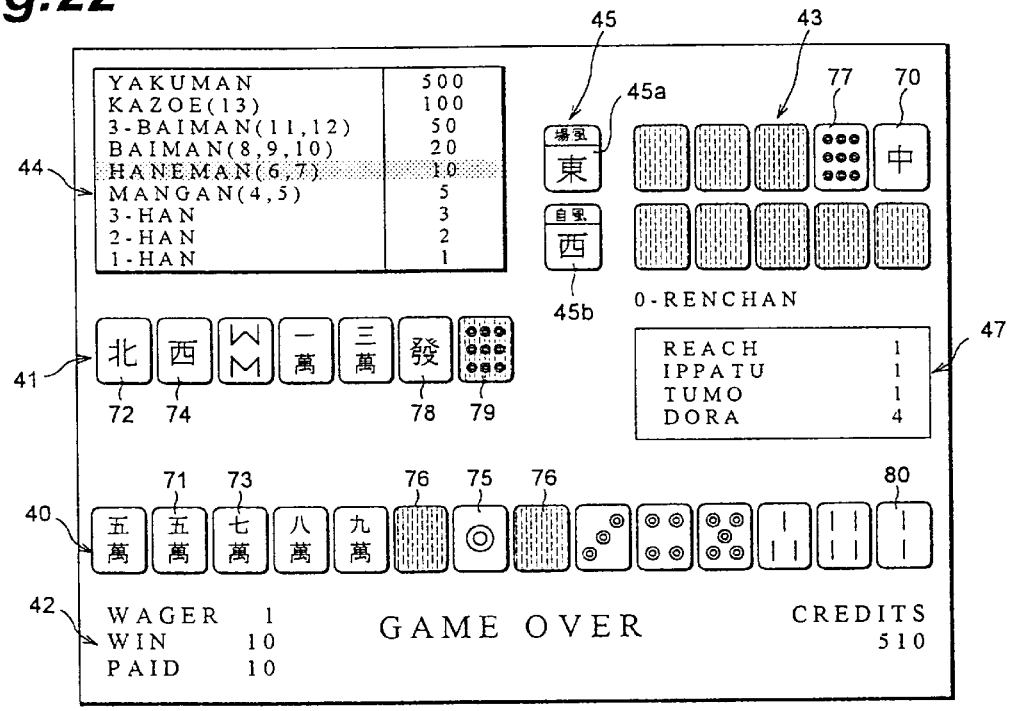

Thereafter, as shown in FIG. 22, the indication of "WINNER" is changed to an indication of "GAME OVER" and, below the indication of "WIN" in the coin display area 42, an indication of "PAID" and its corresponding number are displayed. In the case of a credit system, the number of coins to be paid is added to the number displayed in conjunction with "CREDITS." Consequently, the game is terminated (step 67). In the case of a payout system in which coins are inserted so as to start the game without depending on credit, coins corresponding to the number of coins to be paid out are discharged from the coin discharge slot 3, whereby the game is terminated.

Figure 23:
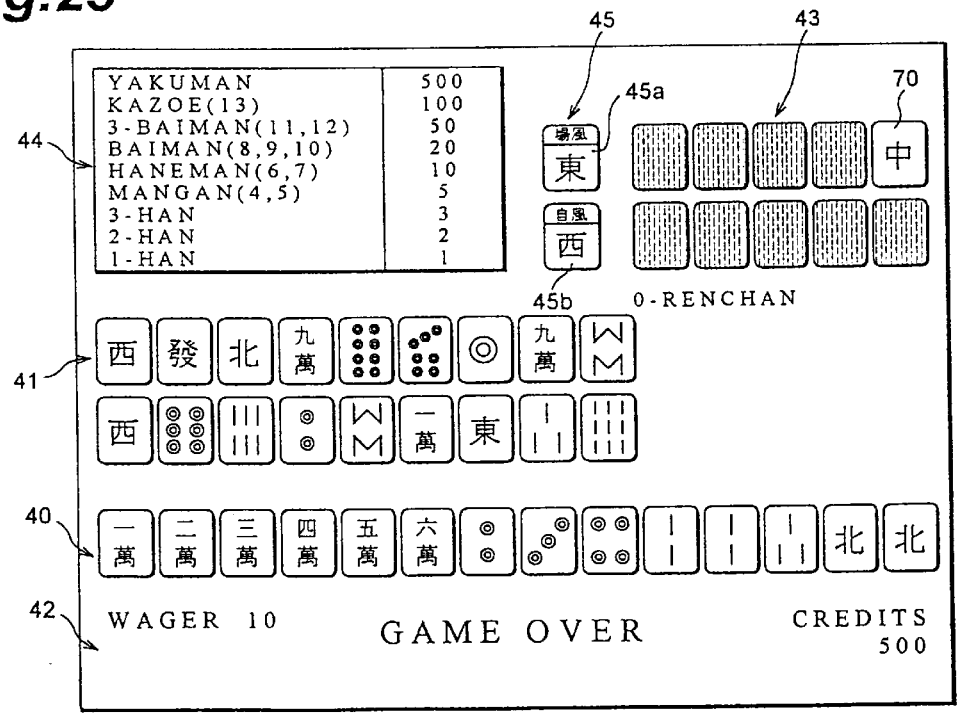

On the other hand, when the drawing from the wall and discarding of tiles are repeated such that the total number of discarded tiles reaches 18 ("YES" at step 61) without the going-out switch 5 being pushed, the hand is judged at the time when the number of the player's tiles finally becomes 14 (step 68). In the case where the hand is completed, a predetermined indication is displayed, and a predetermined number of coins are paid out. In the case where no hand is completed, by contrast, a draw is declared, and then the game is terminated (step 69). FIG. 23 shows the CRT 1 in the state where 18 tiles are discarded while no hand is completed, whereby the game is over.

Also, even when a hand is completed in the proceeding of the game, whether to push the going-out switch 5 or not is at the discretion of the player, and the game can be continued. Of course, no coins are paid out when no hand is completed thereafter by the discarding of tiles and drawing from the wall. Further, since no opponents exist in the game machine in accordance with the present invention, no penalty is imposed on the player in the case of so-called sacred discard. If the going-out switch 5 is pushed in the state where going out is not allowed, it will be considered a mistake in going out, and the game will be over.

In the present invention, detailed rules of a game may freely be set when necessary as long as they are within the scope of the game for a single player. For example, though a concealed additional bonus-indicating tile is not displayed at the time of ready declaration in the foregoing embodiment, it may be displayed so as to be treated in the same manner as the faced-up bonus-indicating tile mentioned above. Also, in the proceeding of the game, voices may appropriately be generated in the cases of kong, ready declaration, and the like, and the player may be informed by an image or sound when a hand is ready. Further, the contents of the point display area 44, detailed information display area 47, and the like may be altered according to the game. For example, in the above-mentioned embodiment, not only the number of doubles but also the basic points in the player's hand may be displayed. The discarded tile may be moved either instantaneously or smoothly.

As explained in the foregoing, in the game machine of the present invention, the player can enjoy the game while concentrating on making hands independently, without playing against the CPU. In particular, it is optimal for a beginner of the game to learn hands, for example.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 076675/1996 filed on Mar. 29, 1996 is hereby incorporated by reference.

What is claimed is:

1. A game machine for a single player in which a predetermined number of elements randomly selected from a plurality of elements are supplied to only the single player, and the single player completes a hand by combining own elements while exchanging an arbitrary unnecessary element for elements randomly supplied, thereby going out, said game machine characterized in that only said single player completes a hand, said game machine comprising:

element data storing means for storing an element data of said plurality of elements;

first selecting means for randomly selecting a predetermined number of elements from elements corresponding to the element data stored in said element data storing means, wherein said predetermined number of elements are selected for only a single hand for use by said single player;

image display means for displaying various kinds of images;

display control means for causing said image display means to show a display image of the selected elements;

residual element data storing means for storing an element data corresponding to an element other than the elements selected by said first selecting means;

an operation switch adapted to select said unnecessary element from said predetermined number of elements shown by said image display means;

element moving means for moving said unnecessary element selected by said operation switch to another display area of said image display means;

second selecting means for randomly selecting an element from the element data stored in said residual element data storing means;

data rewriting means for rewriting, based on the element selected by said second selecting means, the data stored in said residual element data storing means;

going-out data storing means for storing a plurality of going-out data formed by combination of said predetermined number of elements; and going-out judging means for judging whether or not the combination of said predetermined number of elements selected by said first and second selecting means coincides with at least one of said plurality of going-out data, wherein said image display means for displaying various kinds of images comprises:

a point display area for showing a point corresponding to a going-out hand;

an element display area for showing the elements supplied to the single player; and an unnecessary element display area for showing said unnecessary element moved by said element moving means, the element display area and the unnecessary element display area being displayed at the same time.

2. A Mah Jong game machine for a single player in which a predetermined number of tiles randomly selected from a plurality of tiles are supplied to only the single player, and the single player completes a hand by combining own tiles while exchanging an arbitrary unnecessary tile for tiles randomly supplied, thereby going out, said game machine characterized in that only said single player completes a hand, said game machine comprising:

tile data storing means for storing a tile data;

first selecting means for randomly selecting a predetermined number of tiles from tiles corresponding to the tile data stored in said tile data storing means, said predefined number of tiles being selected for only a single hand for use by said single player;

image display means for displaying various kinds of images;

display control means for causing said image display means to show a display image of the selected tiles;

residual tile data storing means for storing a tile data storing a tile data corresponding to a tile other than the tiles selected by said first selecting means;

an operation switch adapted to select said unnecessary tile from said predetermined number of tiles shown by said image display means;

tile moving means for moving said unnecessary tile selected by said operation switch to another display area of said image display means;

second selecting means for randomly selecting a tile from the tile data stored in said residual tile data storing means;

data switching means for rewriting, based on the tile selected by said second selecting means, the data stored in said residual tile data storing means;

hand data storing means for storing a plurality of going-out hand data formed by combination of said predetermined number of tiles; and hand judging means for judging whether or not the combination of said predetermined number of tiles selected by said first and second selected means coincides with at least one of said plurality of hand data, wherein said image display means for displaying various kinds of images comprises:

a point display area for showing a point corresponding to a going-out hand;

a dealt tile display area for showing the tiles selected by said first selecting means and supplied to the player; and a discarded tile display area for showing said unnecessary tile moved by said tile moving means.

3. A game machine for a single player according to claim 2, wherein said image display means further comprises:

a wind tile display area for showing a prevailing wind and the player's own wind;

a bonus display area for displaying a bonus-indicating tile;

a dealer's extra hand number display area for showing a number of dealer's extra hands; and a detailed information display area for showing detailed information of a hand which has gone out.

4. A game machine for a single player according to claim 3, wherein said display areas are disposed so as not to overlap each other.

5. A game machine for a single player according to claim 2, wherein said point display area is located at an upper portion of said image display means, said dealt tile display area is located at a lower portion of said image display means, and said discarded tile display area is located between said point display area and said dealt tile display area such that said point display areas said dealt tile display area and said discarded tile display area are all simultaneously displayed on said image display.

6. A game machine for playing non-opposition solitaire Mah Jong, the game machine having a plurality of tiles associated therewith and being arranged to generate only one playable hand, the game machine comprising:

an image display configured to display images associated with playing non-opposition solitaire Mah Jong, the image display including, a hand display area that displays a single playable hand, a discard tile display area that displays discarded tiles, and a winning hand display area that displays points associated with specific winning hands;

a first random generator arranged to generate a single hand for use by a single player by randomly selecting a predetermined number of tiles from said plurality of tiles to form the single hand to be displayed in the hand display area of the image display, wherein said predetermined number of tiles are generated for only said single hand such that only one playable hand is generated;

a second random generator arranged to randomly select an additional tile for the hand from a remaining group of tiles that were not previously selected;

a discarder for discarding a specified hand tile and moving the discarded tile from the hand display area to the discard tile display area; and a monitor configured to determine whether the hand is one of the displayed winning hands.

7. A game machine as recited in claim 6, wherein said image display further comprises:

a wind tile display area that displays a prevailing wind and a single player wind;

a bonus display area that displays a bonus-indicating tile; and a detailed information display area that displays detailed information about the hand.

8. A game machine as recited in claim 7, wherein the image display areas are disposed so as not to overlap each other.

9. A game machine as recited in claim 6, wherein the winning hand display area is located at an upper portion of the image display, the hand display area is located at a lower portion of said image display, and the discarded tile display area is located between the winning hand display area and the hand display area such that the winning hand display area, the hand display area and the discarded tile display area are all simultaneously displayed on the image display.

10. A game machine for playing a non-opposition solitaire game, the game machine having a plurality of playing elements associated therewith and being arranged to generate only one playable hand, the game machine comprising:

an image display configured to display images associated with playing the non-opposition solitaire game at the same time, the image display including, a hand display area that displays a single playable hand, a discard display area that displays discarded playing elements, and a winning hand display area that displays points associated with specific winning hands;

a first random generator arranged to generate a single hand for use by a single player by randomly selecting a predetermined number of playing elements from said plurality of playing elements to form the single hand to be displayed in the hand display area of the image display, wherein said predetermined number of playing elements are generated for only the single hand such that only one playable hand is generated;

a second random generator arranged to randomly select an additional playing element for the hand from a remaining group of playing elements that were not previously selected;

a discarder for discarding a specified hand playing element and moving the discarded playing element from the hand display area to the discard display area;

a monitor configured to determine whether the hand is one of the displayed winning hands.

* * * * *